US006457533B1

(12) United States Patent
Metcalfe

(10) Patent No.: US 6,457,533 B1
(45) Date of Patent: Oct. 1, 2002

(54) DOWNHOLE TUBING

(75) Inventor: Paul David Metcalfe, North Wing (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/462,654

(22) PCT Filed: Jul. 13, 1998

(86) PCT No.: PCT/GB98/02066

§ 371 (c)(1),
(2), (4) Date: Dec. 19, 2000

(87) PCT Pub. No.: WO99/02818

PCT Pub. Date: Jan. 21, 1999

(30) Foreign Application Priority Data

Jul. 12, 1997 (GB) ..... 9714651

(51) Int. Cl.[7] ..... E21B 43/10

(52) U.S. Cl. ..... 166/381; 166/384; 166/385; 166/387; 166/207; 166/217

(58) Field of Search ..... 166/378, 381, 166/382, 384, 385, 387, 207, 217, 277

(56) References Cited

U.S. PATENT DOCUMENTS

| | | | | |
|---|---|---|---|---|
| 761,518 | A | 5/1904 | Lykken | |
| 988,054 | A | 3/1911 | Wiet | |
| 1,301,285 | A | 4/1919 | Leonard | |
| 1,324,303 | A | 12/1919 | Carmichael | |
| 1,545,039 | A | 7/1925 | Deavers | |
| 1,561,418 | A | 11/1925 | Duda | |
| 1,569,729 | A | 1/1926 | Duda | |
| 1,597,212 | A | 8/1926 | Spengler | |
| 1,880,218 | A | 10/1932 | Simmons | |
| 1,930,825 | A | 10/1933 | Raymond | |
| 1,981,525 | A | 11/1934 | Price | |
| 2,017,451 | A | 10/1935 | Wickersham | |
| 2,214,226 | A | 9/1940 | English | |
| 2,383,214 | A | 8/1945 | Prout et al. | 153/82 |
| 2,424,878 | A | 7/1947 | Crook | 154/82 |
| 2,499,630 | A | 3/1950 | Clark | 153/81 |
| 2,519,116 | A | 8/1950 | Crake | |

(List continued on next page.)

FOREIGN PATENT DOCUMENTS

| | | | |
|---|---|---|---|
| DE | 3213464 A1 | 10/1983 | B23B/45/12 |
| DE | 4133802 C1 | 10/1992 | F16L/9/12 |
| EP | 0 952 305 A1 | 4/1998 | E21B/43/10 |

(List continued on next page.)

OTHER PUBLICATIONS

USSN 60/202335, filed May 5, 2000.
USSN 09/554677, filed Nov. 19, 1998.
USSN 09/530301, filed Nov. 2, 1998.

(List continued on next page.)

*Primary Examiner*—Roger Schoeppel
(74) *Attorney, Agent, or Firm*—Moser, Patterson & Sheridan, L.L.P.

(57) ABSTRACT

There is provided a downhole tubing sealing system (10) comprising a radially expandable slotted tubular body (16) carrying deformable material (22) on the exterior thereof; and a seal member (26) for location within the tubular body and for engaging an inner surface of said body. There is further provided a method of sealing a portion of a downhole bore, the method comprising locating a radially expandable slotted tubular body (16) carrying deformable material (22) on the exterior thereof in a bore, expanding the body radially into contact with the bore wall, and locating a seal member (26) within the body and radially extending the seal member to engage an inner surface of the body, so sealing portion of the downhole bore.

14 Claims, 2 Drawing Sheets

U.S. PATENT DOCUMENTS

| | | | | |
|---|---|---|---|---|
| 2,627,891 | A | 2/1953 | Clark | 153/82 |
| 2,633,374 | A | 3/1953 | Boice | 285/118 |
| 2,663,073 | A | 12/1953 | Bieber et al. | 29/148 |
| 2,898,971 | A | 8/1959 | Hempel | 153/82 |
| 3,028,915 | A | 4/1962 | Jennings | |
| 3,039,530 | A | 6/1962 | Condra | 166/55 |
| 3,087,546 | A | 4/1963 | Wooley | |
| 3,167,122 | A | 1/1965 | Lang | |
| 3,179,168 | A | 4/1965 | Vincent | |
| 3,186,485 | A | 6/1965 | Owen | 166/63 |
| 3,191,677 | A | 6/1965 | Kinley | |
| 3,191,680 | A | 6/1965 | Vincent | |
| 3,195,646 | A | 7/1965 | Brown | 166/208 |
| 3,203,451 | A | 8/1965 | Vincent | 138/143 |
| 3,203,483 | A | 8/1965 | Vincent | 166/207 |
| 3,245,471 | A | 4/1966 | Howard | |
| 3,297,092 | A | 1/1967 | Jennings | 166/207 |
| 3,326,293 | A | 6/1967 | Skipper | 166/150 |
| 3,353,599 | A | 11/1967 | Swift | |
| 3,354,955 | A | 11/1967 | Berry | |
| 3,467,180 | A | 9/1969 | Pensotti | 165/180 |
| 3,477,506 | A | 11/1969 | Malone | 166/207 |
| 3,489,200 | A | 1/1970 | Kinley | 166/277 |
| 3,583,200 | A | 6/1971 | Cvijanovic et al. | 72/393 |
| 3,669,190 | A | 6/1972 | Sizer et al. | 166/315 |
| 3,689,113 | A | 9/1972 | Blaschke | 285/90 |
| 3,691,624 | A | 9/1972 | Kinley | 29/523 |
| 3,712,376 | A | 1/1973 | Owen et al. | 166/277 |
| 3,746,091 | A | 7/1973 | Owen et al. | 166/207 |
| 3,776,307 | A | 12/1973 | Young | 166/125 |
| 3,780,562 | A | 12/1973 | Kinley | 72/479 |
| 3,785,193 | A | 1/1974 | Kinley et al. | 72/393 |
| 3,818,734 | A | 6/1974 | Bateman | 72/75 |
| 3,820,370 | A | 6/1974 | Duffy | 72/75 |
| 3,911,707 | A | 10/1975 | Minakov et al. | 72/76 |
| 3,948,321 | A | 4/1976 | Owen et al. | 166/277 |
| 3,977,076 | A | 8/1976 | Vieira et al. | 30/103 |
| 4,069,573 | A | 1/1978 | Rogers, Jr. et al. | 29/421 R |
| 4,127,168 | A | 11/1978 | Hanson et al. | 166/123 |
| 4,159,564 | A | 7/1979 | Cooper, Jr. | 29/727 |
| 4,288,082 | A | 9/1981 | Setterberg, Jr. | 277/125 |
| 4,319,393 | A | 3/1982 | Pogonowski | 29/434 |
| 4,324,407 | A | 4/1982 | Upham et al. | 277/27 |
| 4,349,050 | A | 9/1982 | Bergstrom et al. | 138/147 |
| 4,359,889 | A | 11/1982 | Kelly | 72/62 |
| 4,362,324 | A | 12/1982 | Kelly | 285/119 |
| 4,382,379 | A | 5/1983 | Kelly | 73/46 |
| 4,387,502 | A | 6/1983 | Dom | 29/568 |
| 4,407,150 | A | 10/1983 | Kelly | 72/61 |
| 4,414,739 | A | 11/1983 | Kelly | 29/727 |
| 4,429,620 | A | 2/1984 | Burkhardt et al. | 91/395 |
| 4,445,201 | A | 4/1984 | Pricer | 365/154 |
| 4,450,612 | A | 5/1984 | Kelly | 72/62 |
| 4,470,280 | A | 9/1984 | Kelly | 72/61 |
| 4,483,399 | A | 11/1984 | Colgate | 166/308 |
| 4,487,630 | A | 12/1984 | Crook et al. | 75/123 B |
| 4,502,308 | A | 3/1985 | Kelly | 72/58 |
| 4,505,142 | A | 3/1985 | Kelly | 72/54 |
| 4,505,612 | A | 3/1985 | Shelly, Jr. | 405/101 |
| 4,531,581 | A | 7/1985 | Pringle et al. | 166/120 |
| 4,567,631 | A | 2/1986 | Kelly | 29/157.3 |
| 4,581,617 | A | 4/1986 | Yoshimoto et al. | 346/108 |
| 4,588,030 | A | 5/1986 | Blizzard | 166/120 |
| 4,626,129 | A | 12/1986 | Kothmann et al. | 405/43 |
| 4,697,640 | A | 10/1987 | Szarka | 166/120 |
| 4,807,704 | A | 2/1989 | Hsu et al. | 166/313 |
| 4,848,469 | A | 7/1989 | Baugh et al. | 166/382 |
| 4,866,966 | A | 9/1989 | Hagan | 72/75 |
| 4,883,121 | A | 11/1989 | Zwart | 166/217 |
| 4,976,322 | A | 12/1990 | Abdrakhmanov et al. | 175/57 |
| 4,997,320 | A | 3/1991 | Hwang | 408/22 |
| 5,014,779 | A | 5/1991 | Meling et al. | 166/55.7 |
| 5,052,483 | A | 10/1991 | Hudson | 166/55 |
| 5,052,849 | A | 10/1991 | Zwart | 403/300 |
| 5,156,209 | A | 10/1992 | McHardy | 166/324 |
| 5,267,613 | A | 12/1993 | Zwart et al. | 166/178 |
| 5,271,472 | A | 12/1993 | Leturno | 175/107 |
| 5,301,760 | A | 4/1994 | Graham | 175/61 |
| 5,307,879 | A | 5/1994 | Kent | 166/382 |
| 5,322,127 | A | 6/1994 | McNair et al. | 166/313 |
| 5,348,095 | A | 9/1994 | Worrall et al. | 166/380 |
| 5,366,012 | A | 11/1994 | Lohbeck | 166/277 |
| 5,409,059 | A | 4/1995 | McHardy | 166/208 |
| 5,435,400 | A | 7/1995 | Smith | 175/61 |
| 5,472,057 | A | 12/1995 | Winfree | 175/57 |
| 5,520,255 | A | 5/1996 | Barr et al. | 175/24 |
| 5,553,679 | A | 9/1996 | Thorp | 175/73 |
| 5,560,426 | A | 10/1996 | Trahan et al. | 166/120 |
| 5,636,661 | A | 6/1997 | Moyes | 137/614.2 |
| 5,667,011 | A | 9/1997 | Gill et al. | 166/295 |
| 5,685,369 | A | 11/1997 | Ellis et al. | 166/195 |
| 5,706,905 | A | 1/1998 | Barr | 175/61 |
| 5,785,120 | A | 7/1998 | Smalley et al. | 166/55 |
| 5,887,668 | A | 3/1999 | Haugen et al. | 175/79 |
| 5,901,787 | A | 5/1999 | Boyle | 166/135 |
| 5,901,789 | A | 5/1999 | Donnelly et al. | 166/381 |
| 5,924,745 | A | 7/1999 | Campbell | 285/90 |
| 5,960,895 | A | 10/1999 | Chevallier et al. | 175/27 |
| 5,979,571 | A | 11/1999 | Scott et al. | 175/61 |
| 6,021,850 | A | 2/2000 | Wood et al. | 166/380 |
| 6,029,748 | A | 2/2000 | Forsyth et al. | 166/380 |
| 6,070,671 | A | 6/2000 | Cumming et al. | 166/381 |
| 6,098,717 | A | 8/2000 | Bailey et al. | 166/382 |

FOREIGN PATENT DOCUMENTS

| | | | |
|---|---|---|---|
| EP | 0 961 007 | 12/1999 | E21B/33/10 |
| GB | 730338 | 3/1954 | 84/4 |
| GB | 792886 | 4/1956 | |
| GB | 997721 | 7/1965 | |
| GB | 1277461 | 6/1972 | B21D/39/04 |
| GB | 1448304 | 9/1976 | E21B/33/13 |
| GB | 1457843 | 12/1976 | B21D/39/10 |
| GB | 1582392 | 1/1981 | B21D/39/10 |
| GB | 2216926 A | 10/1989 | E21B/7/20 |
| GB | 2 313 860 B | 6/1996 | E21B/10/34 |
| GB | 2 320 734 | 7/1998 | E21B/33/127 |
| GB | 2329918 A | 4/1999 | E21B/43/10 |
| WO | WO 92/01139 | 1/1992 | E21B/17/08 |
| WO | WO 93/24728 | 12/1993 | E21B/17/10 |
| WO | WO 93/25800 | 12/1993 | E21B/43/10 |
| WO | WO 94/25655 | 11/1994 | D04C/1/06 |
| WO | WO 97/21901 | 6/1997 | E21B/17/08 |
| WO | WO 98/00626 | 1/1998 | E21B/43/10 |
| WO | WO 99/02818 | 1/1999 | E21B/43/10 |
| WO | WO 99/18328 | 4/1999 | E21B/23/01 |
| WO | WO 99/23354 | 5/1999 | E21B/43/10 |

OTHER PUBLICATIONS

USSN 09/470176, filed Dec. 22, 1999.
USSN 09/470154, Dec. 22, 1999.
USSN 09/469692, Dec. 22, 1999.
USSN 09/46981, filed Dec. 22, 1999.
USSN 09/469643, filed Dec. 22, 1999.
USSN 09/469526, filed Dec. 22, 1999.
USSN 09/469690, filed Dec. 22, 1999.
Metcalfe, P.–"Expandable Slotted Tubes Offer Well Design Benefits", *Petroleum Engineer International*, vol. 69, No. 10 (Oct. 1996), pp. 60–63—XP000684479.

DOWNHOLE TUBING

This invention relates to downhole tubing, a downhole tubing sealing system, and to elements of such a system. The invention also relates to a method of lining a bore and to a method for sealing downhole tubing.

In oil and gas extraction operations, a bore is drilled through the earth to intersect a hydrocarbon-bearing formation which forms the hydrocarbon reservoir, allowing oil and gas from the reservoir to be transported to the surface. The bore intersecting the reservoir is typically lined with steel casing which is cemented in the bore. A perforating gun is then lowered into the bore and detonated to form perforations which extend through the casing and the cement and into the formation. Typically, sets of perforations are provided at intervals along the casing, and the perforated casing may extend for several thousand metres through the formation. To control the flow of oil from the formation inflatable packers may be provided to isolate selected sets of perforations and thus isolate the corresponding portions of the formation.

It has recently been proposed that such cemented and perforated casing be replaced by expandable slotted tubing, such as described in WO93\25800 (Shell Internationale Research Maatschappij B. V.). Such tubing comprises lengths of tube which have been machined to create a large number of overlapping longitudinal slots. The tube is radially expanded, while downhole, into contact with the bore wall, the slots extending to create diamond-shaped apertures. The expanded tube thus provides support for the bore wall while allowing oil to flow into the bore through the extended slots.

It is among the objectives of embodiments of the present invention to provide a system which allows a section of bore wall lined with such expanded tubing to be sealed or isolated, and thus facilitate control of the flow of oil from a hydrocarbon reservoir.

According to one aspect of the present invention there is provided downhole tubing comprising a radially expandable slotted tubular body carrying deformable material on the exterior thereof.

According to a further aspect of the present invention there is provided a downhole tubing sealing system comprising a radially expandable slotted tubular body carrying deformable material on the exterior thereof, and a seal member for location within the body and for engaging an inner surface of the body.

In use, the tubular body is located in a bore and expanded radially into contact with the bore wall. The presence of the deformable material on the exterior of the body ensures that full contact is achieved between the outer surface of the body and the bore wall. The sealing member is then activated to engage the inner surface of the body and provides a sealing contact therewith. The length of the seal member and/or the location of the seal member in the body is selected such that none of the slots in the body extend beyond both ends of the seal member; otherwise, fluid would be able to flow around the seal member by passing along the slots.

According to another aspect of the present invention there is provided a method of isolating a portion of a downhole bore, the method comprising the steps of:

- providing a radially expandable slotted tubular body carrying deformable material on the exterior thereof;
- locating the body in a bore and expanding the body radially into contact with the bore wall; and
- locating a seal member within the body and radially extending the member to engage an inner surface of the body.

As used herein the terms "slots" is intended to encompass any holes or apertures which facilitate expansion of the body, including bores, slots or weakened areas which initially only extend part way through the body.

These aspects of the invention permit the complete sealing of a bore lined with expanded slotted tubing. Conventional expanded slotted metal tubing does not achieve a fluid-tight metal-to-rock contact: because the outer surface of the tubing tends to retain its original curvature, that is the curvature of the unexpanded tubing, not all of the outer surface contacts the bore wall following expansion. With the inner surface sealed, for example by a packer, there remains a small area S-shaped leak path between the tubing and the bore wall where the tubing is not in contact with the wall; this leak path may account for around 0.5% of the cross sectional area of a bore. However, with the present invention the deformable material on the outer surface of the body allows complete contact between the body and the bore wall and eliminates this leak path.

Preferably, the deformable material is an elastomer. Of course the deformable material will be selected to withstand handling and the conditions experienced downhole, for example the selected material preferably bonds to the body outer surface sufficiently to prevent erosion or degradation during installation, withstands the elevated temperatures experienced downhole (typically 130–180° C.), and is resistant to crude oils, brines, acids and other fluids likely to be encountered downhole.

According to a further aspect of the present invention there is provided a method of lining a downhole bore, the method comprising the steps of:

- providing a radially expandable slotted tubular body carrying deformable material on the exterior thereof; and
- locating the body in a bore and expanding the body radially into contact with the bore wall.

These and other aspects of the present invention will now be described, by way of example, with reference to the accompanying drawings, in which.

Figure 1:
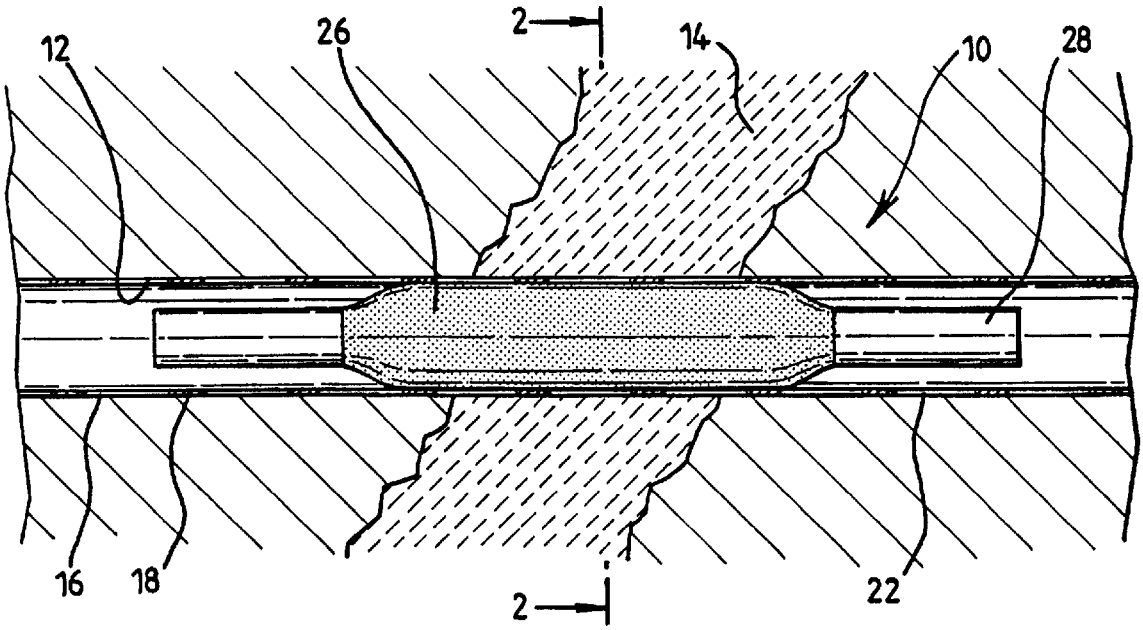
FIG. 1 is a schematic sectional view of a downhole sealing system in accordance with an embodiment of the present invention, shown in a bore.

The drawings illustrate a downhole tubing sealing system 10 in accordance with an embodiment of the present invention. The system 10 is shown, in FIG. 1 of the drawings, in a drilled horizontal bore 12 which intersects an oil bearing formation or reservoir 14.

The system 10 includes tubing 16, similar to that as described in WO93\25800 (Shell Internationale Research Maatschappij B. V.), which includes a large number of overlapping longitudinal slots 18. The tubing 16 is run into the bore 12 in unexpanded configuration and a mandrel then pushed up or pulled through the tubing 16 to expand the tubing radially outwards. The expansion is accommodated by the extension of the slots 18 to form the diamond shaped apertures as illustrated in FIG. 3 of the drawings. As may be seen in FIG. 2 of the drawings, the tubing 16 is expanded into contact with the bore wall 22, and thus provides support for the bore wall 20 while allowing oil to flow from the reservoir through the expanded slots 18.

The tubing 16 is formed of an appropriate metal, typically steel, and carries an external coating of a deformable material in the form of an elastomer 22. The provision of the elastomer coating allows the outer surface of the tubing 16 to form a sealing contact with the bore wall 20, as described below.

Figure 2:
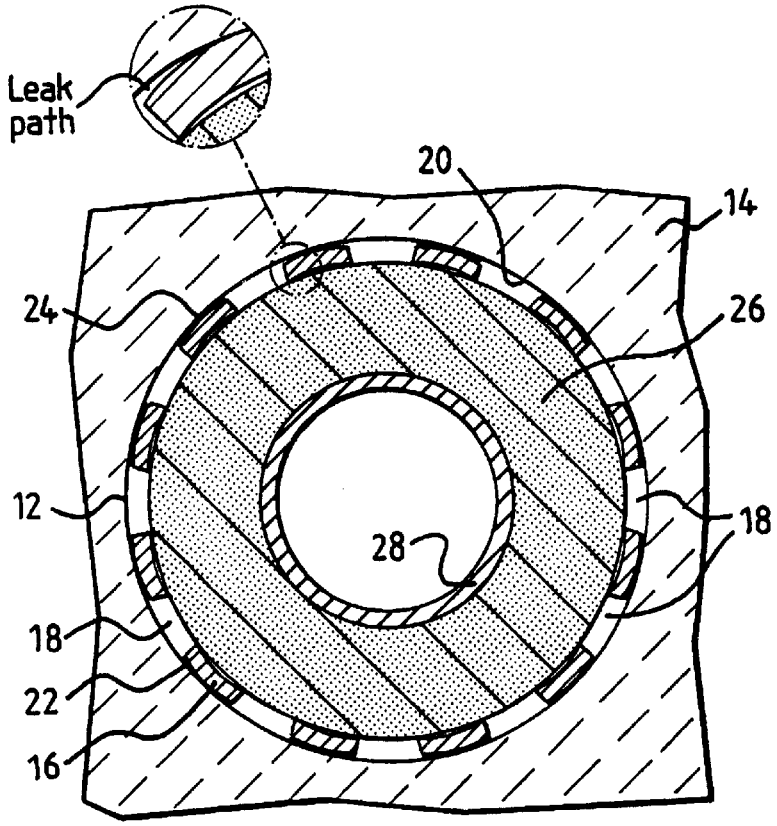
FIG. 2 is an enlarged sectional view on line 2—2 of FIG. 1.
Figure 3:
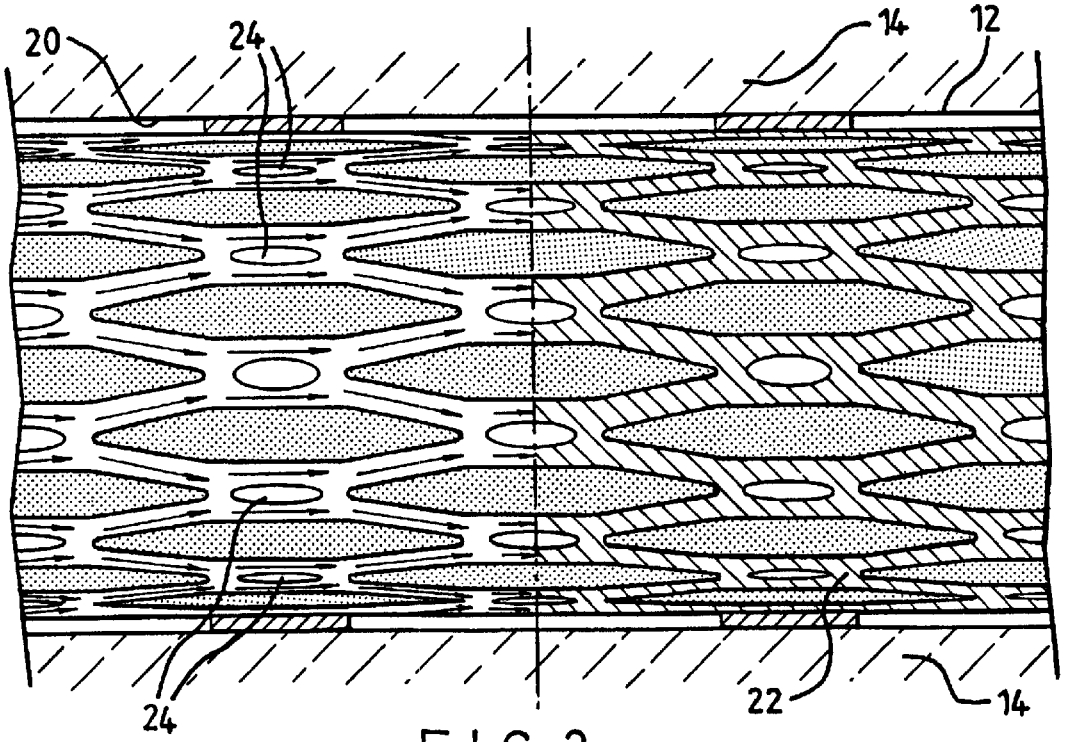
FIG. 3 is an enlarged side view of the tubing of system of FIG. 1, one half of the Figure illustrating the effect of the absence of a deformable material coating as provided in embodiments of the present invention.

On expansion of the tubing 16, the metal outer surface of the tubing tends to retain its original curvature, that is the curvature of the unexpanded tubing, as may be seen from FIG. 2. As a result, in the absence of an elastomer coating 22, not all of the outer surface of the tubing would contact the bore wall 22 following expansion; metal-to-rock contact would only be achieved at the contact points 24 as indicated in FIGS. 2 and 3. Thus, it may be seen that, in the absence of the elastomer coating, a small area S-shaped leak path would remain between the tubing and the bore wall where the tubing was not in contact with the wall. However, in the present invention, differential compression of the elastomer coating 22 ensures that there is an elastomer-to-rock contact around the circumference of the tubing (though of course not at the slots 18).

In the illustrated example the reservoir 14 has been isolated from the bore 12 by providing a packer 26 within the tubing 16, the packer providing a sealing contact with the interior of the tubing 16 over the length of the intersection of the bore 12 with the reservoir 14. The packer 26 is mounted on a tube 28 which allows fluid to flow past the isolated reservoir 14.

It will be apparent to those of skill in the art that the above-described embodiment provides numerous advantages. over conventional cemented and perforated casing systems, and also other methods of sealing expanded slotted tubing, such as providing an external isolation sleeve on the tubing. With the present invention, the whole length of the tubing may contribute to flow as all of the slots in the tubing are normally opened. Further, the internal sealing member or packer may be provided at any location in the tubing, and is thus adaptable to deal with any situation or problems that may arise in a bore.

It will also be clear to those of skill in the art that the above-described embodiment is merely exemplary of the present invention, and that various modifications and improvements may be made thereto, without departing from the scope of the present invention.

What is claimed is:

1. Downhole tubing for location in a bore, the tubing comprising a slotted tubular body carrying doformable material on the exterior thereof, the body being radially expandable from a first diameter to an expanded configuration in which the body defines a larger second diameter and contacts the bore wall, in the expanded configuration the slots permitting radial flow of fluid from the bore wall into the body and wherein the deformable material provides a substantially fluid tight contact with the bore wall.

2. The downhole tubing of claim 1 wherein said deformable material is an elastomer.

3. The downhole tubing of claim 2 wherein said elastomer is selected to be resistant to high temperatures, and to crude oils, brines, acids, and other degradative fluids encountered downhole.

4. The downhole tubing of claim 1, wherein the deformable material is carried on the exterior of a slotted portion of the tubular body.

5. A downhole tubing sealing system comprising: tubing for location in a bore, the tubing comprising a slotted tubular body carrying deformable material on the exterior thereof, the body being radially expandable from a first diameter to an expanded configuration in which the body defines a larger second diameter and contacts the bore wall, in the expanded configuration the slots permitting radial flow of fluid from the bore wall into the body; and a seal member for location within said body and for enqaging an inner surface of said body.

6. A method of isolating a portion of a downhole bore, the method comprising the steps of:

providing a radially expandable slotted tubular body carrying deformable material on the exterior thereof;

locating said body in a bore and expanding said body radially into contact with the bore wall; and locating a seal member within said body, and radially extending said member to engage an inner surface of said body.

7. A method of lining a downhole bore, the method comprising the steps of:

providing a radially expandable slotted tubular body carrying deformable material on the exterior thereof;

locating said body in a bore; and expanding said body radially into contact with the bore wall, wherein the deformable material provides a substantially fluid tight contact with the bore wall and whereby fluid may flow radially inwardly from the bore wall through the slots and into the body.

8. Downhole tubing comprising a radially expandable tubular metal body defining a plurality of overlapping longitudinal slots and having an external coating of deformable material thereon.

9. A tubular for use in a well, comprising:

a expandable slotted tubular body; and a deformable seal material disposed on an exterior of a slotted portion of the body.

10. The tubular of claim 9, wherein the body is expanded into contact with a borewall.

11. The tubular of claim 9, the body further comprising a seal m ember for engaging an inner surface of the body.

12. The tubular of claim 11, wherein the seal member has an axial channel formed therethrough.

13. The tubular of claim 9, wherein the seal material comprises an elastomer.

14. The tubular of claim 13, wherein the elastomer is resistant to high temperatures, to crude oils, brines, and acids, other degradative fluids encountered downhole, or combinations thereof.

* * * * *

UNITED STATES PATENT AND TRADEMARK OFFICE

CERTIFICATE OF CORRECTION

PATENT NO. : 6,457,533 B1 
DATED : October 1, 2002
INVENTOR(S) : Paul David Metcalfe It is certified that error appears in the above-identified patent and that said Letters Patent is hereby corrected as shown below:

Column 3,
Line 43, please change “doformable” to -- deformable --.

Column 4,
Line 12, please change “enqaging” to -- engaging --.
Line 46, please change “m ember” to -- member --.

Signed and Sealed this

Twenty-eighth Day of January, 2003

JAMES E. ROGAN
*Director of the United States Patent and Trademark Office*